US005743396A

United States Patent [19]

Short et al.

[11] Patent Number: 5,743,396

[45] Date of Patent: Apr. 28, 1998

[54] ROPE STOWAGE DEVICE AND METHOD

[75] Inventors: Brian Malcolm Short; John Kenneth Yeardley, both of London, England

[73] Assignee: Bridon PLC, United Kingdom

[21] Appl. No.: 427,135

[22] Filed: Apr. 24, 1995

[51] Int. Cl.[6] ..... B65D 85/00

[52] U.S. Cl. ..... 206/388; 114/254; 242/47; 242/129.5

[58] Field of Search ..... 206/388, 389; 242/47, 53, 129.5, 141, 146, 127; 114/230, 242, 251, 253, 254

[56] References Cited

U.S. PATENT DOCUMENTS

| | | | |
|---|---|---|---|
| 593,211 | 11/1897 | Hall | 206/368 |
| 1,473,578 | 11/1923 | Greve | 206/388 |
| 1,545,730 | 7/1925 | Benson | 206/388 |
| 2,120,910 | 6/1938 | Shephard | 206/388 |
| 2,625,404 | 1/1953 | Treiber . | |
| 3,011,852 | 12/1961 | Mahan | 206/446 |
| 3,340,919 | 9/1967 | Holbrook | 383/117 |
| 3,802,987 | 4/1974 | Noll | 206/443 |
| 4,958,486 | 9/1990 | Stahlecker | 242/47 |
| 5,024,324 | 6/1991 | Whittaker | 206/388 |
| 5,413,214 | 5/1995 | Schonke | 206/388 |

FOREIGN PATENT DOCUMENTS

| | | | |
|---|---|---|---|
| 1055901 | 1/1953 | France . | |
| 1109970 | 2/1956 | France | 206/388 |
| 168101 | 2/1905 | Germany . | |
| 2754936 | 6/1978 | Germany | 206/388 |
| 4202715 | 8/1993 | Germany . | |
| 4313638 | 11/1994 | Germany . | |
| 2107675 | 5/1983 | United Kingdom | 242/129.5 |
| 2136462 | 9/1984 | United Kingdom | 242/47 |

*Primary Examiner*—Jimmy G. Foster

*Attorney, Agent, or Firm*—Haynes and Boone; James R. Bell; H. Dale Langley, Jr.

[57] ABSTRACT

The invention provides a method of stowing a rope or the like. The method comprises the steps of: placing a first looped portion of a rope in a longitudinally extending cavity; and placing successive adjacent looped portions of the rope in respective next adjacent longitudinally extending cavities. The method employs a device which may comprise a number of tubular members defining the rope stowing cavities arranged in juxtaposed relationship. Alternatively, the device may comprise a housing, the interior of which is subdivided to provide the rope stowing cavities. The rope end device combination of the invention is intended as an emergency tow pack for a sea-going vessel.

12 Claims, 1 Drawing Sheet

ROPE STOWAGE DEVICE AND METHOD

BACKGROUND OF THE INVENTION

The present invention relates to a method and device for stowing a rope and a device therefor. In particular, the invention relates to a method of stowing a rope to provide an emergency tow pack device for use with water borne vessels.

It is generally accepted that some of the many crude oil spiliages at sea could be prevented if rescue tugs are able to more easily and quickly secure tow lines to stricken crude oil carrying vessels to prevent their running aground.

Whilst water-borne vessels generally, and crude oil carrying vessels particularly, carry various emergency equipment, experience has shown that there is a greatly felt need for the provision on such vessels of an emergency tow line (rope) stowed in a readily available manner that permits the tow line to be quickly withdrawn from its stowed state, for use.

It is an object of the present invention to meet this need.

SUMMARY OF THE INVENTION

According to a first aspect of the present invention there is provided a method of stowing a rope or the like comprising the steps of:

(a) placing a first looped portion of a rope in a longitudinally extending cavity; and (b) placing successive adjacent looped portions of the rope in respective next adjacent longitudinally extending cavities.

The method may include the step of stowing successive adjacent portions of the rope in respective next adjacent longitudinally extending cavities such that free ends of the rope extend outwardly from their respective cavities for easy access.

Alternatively, free ends may be stowed in their respective cavities, but in such a manner that they can be readily accessed for use.

The method may also include the step of forming at least one of said free ends to provide a spliced eye.

Where the longitudinally extending cavities each have two generally oppositely facing open ends, the method may include the step of placing successive looped portions of rope in said next adjacent longitudinally extending cavities such that some of the looped portions extend beyond the open ends of their respective cavities.

The method may even include the step of stowing a rope such that both free ends of the rope are presented for use at open ends of their respective cavities, wherein said open ends lie in generally the same plane.

According to a second aspect of the present invention there is provided a device for implementing the method according to the next six preceding paragraphs, said device including a member or members comprising a number of juxtaposed longitudinally extending cavities wherein each of said cavities, in use, can accommodate a respective looped portion of a rope therein.

The device may comprise a number of tubular members each of which has a longitudinally extending cavity and at least one open end through which, in use, a respective looped portion of a rope can be inserted for stowing in the cavity or withdrawing for use.

The tubular members may be arranged such that the longitudinal axes of their cavities are generally parallel.

The tubular members may each have identical cross sections which are preferably circular.

The tubular members may be located in juxtaposed relationship by securing said members together using a suitable adhesive.

Preferably, the tubular members are secured to a sheet-form base member by means of at least one strap means extending from a fixing point at one edge portion of the base member around the tubular members to another fixing point on an oppositely facing edge portion of said base member.

Alternatively, the tubular member are located in juxtaposed relationship within a housing surrounding said members.

The tubular members are preferably located in juxtaposed relationship in N rows of M columns, where N and M are whole numbers.

The base member may include handle means to enable said device to be lifted.

The base member may include means to enable said device to be towed.

Alternatively, the device may comprise a member in the form of a housing having an interior space and partition members to divide said interior space into juxtaposed longitudinally extending cavities, wherein each of said cavities, in use, can accommodate a respective looped portion of a rope.

The housing may have lid means to enable the interior space comprising the cavities to be closed.

The housing may include means to enable the device to be lifted or towed.

According to a third aspect of the present invention there is provided a device according to the next thirteen preceding paragraphs including a rope stowed therein in accordance with the method of the first aspect of the invention.

The device and stowed rope combination may comprise an emergency tow pack for a water-borne vessel.

BRIEF DESCRIPTION OF THE DRAWINGS

The foregoing and further features of the present invention will be more readily understood from the following description of preferred embodiments, by way of example thereof, with reference to the accompanying drawings, of which.

DESCRIPTION OF PREFERRED EMBODIMENTS

Figure 1:
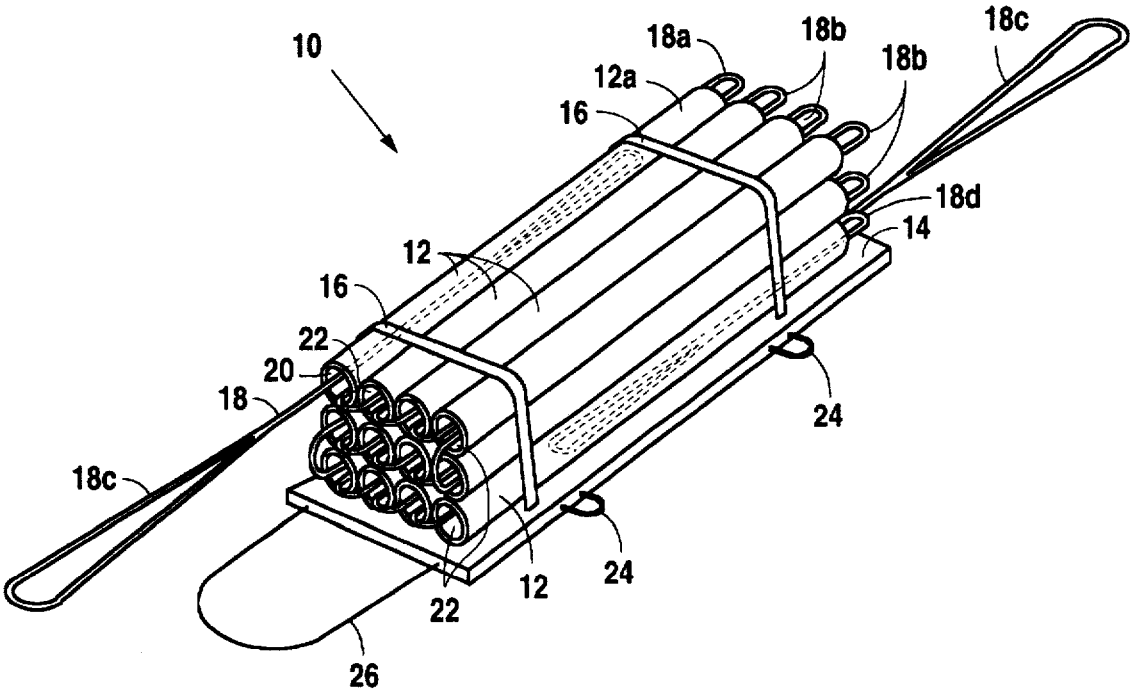
FIG. 1 is an above perspective view of a preferred embodiment of a rope stowing device with a rope stowed therein according to the invention.

A preferred embodiment of a rope stowing device 10 comprising a number of tubular members 12 secured to a sheet-form base member 14 is shown in FIG. 1. The tubular members 12 are arranged in rows and columns and are secured relative to the base member 14 by means of straps 16 fixed to the base member 14 and extending around the tubular members 12. However, the tubular members 12 can be secured relative to the base member 14 by any suitable means including adhesive. The members 12 may be generally rigid and formed of non-corrosive material such as polyester or any plastics material. However, the members 12 may comprise heavy duty fabric tubes which are, of course, flexible. The tubular members 12 are arranged such that their longitudinal axes are generally parallel.

Each of the tubular members 12 is open at both of its ends although it will be understood from the following description that it is only necessary for the purpose of the invention that each of said members 12 has one open end provided, of course, that in such case said members are arranged with their open ends generally lying in a common plane.

In use, as illustrated in FIG. 1, a rope 18 is stowed in the device 10 by placing a first looped portion 18*a* of the rope 18 in a longitudinally extending cavity 20 of a first tubular member 12*a* and then placing successive looped portions 18*b* of the rope 18 in next adjacent longitudinal cavities 22 of next adjacent tubular members 12. The first looped portion 18*a* of the rope 18 is stowed in such a way that a first hooped end portion (eye) 18*c* of the rope 18 extends from said member 12. Similarly, a last looped portion 18d of the rope 18 is stowed such that a second hooped end (eye) portion 18*e* of the rope extends from its respective tubular memeber 12, although, in this case, the second eye 18*e* extends outwardly from the device 10 on a side opposite to that from which the first eye 18*c* extends. Although not shown, the eyes (18*c*, 18*e*) may be formed on metal thimbles and may be provided with shackles.

The device 10 allows a rope 18 to be relatively compactly stowed ready for use. More importantly, the rope 18 is stowed such that it can be withdrawn without snagging or knotting, a problem often encountered when unfurling coiled ropes.

It is intended that the device 10 (or devices) will be located on a water-borne vessel's deck at a position (or positions) most suited for use.

The stowed rope 18 may be used as a tow line to be secured between a rescue tug and a water-borne vessel or as a drag line used to secure a tow line. In either case, the rope is ready available for use. In use, the second eye 18*e* is placed around a bollard or may even be connected to a winch or a chain. In particular, it is envisaged that the rope 18 can be deployed in an emergency when there is no power on the water-borne vessel, the rope being pulled free from the device 10 by an attendant tug.

It will be understood that the rope 18 may be stowed in the device 10 such that both eyes (18*c*, 18*e*) extend outwardly from the same side of the device 10. This has the advantage that when the rope 18 is withdrawn from the device 10, the rope is clear of the device which can then be removed to prevent it becoming an obstruction.

In broken outline in FIG. 1 it is shown that the eyes (18*c*, 18*e*) of the rope 18 can be stowed in their respective tubular members 12 ready for use.

The device 10 has lifting handles 24 and a towing handle 26.

Figure 2:
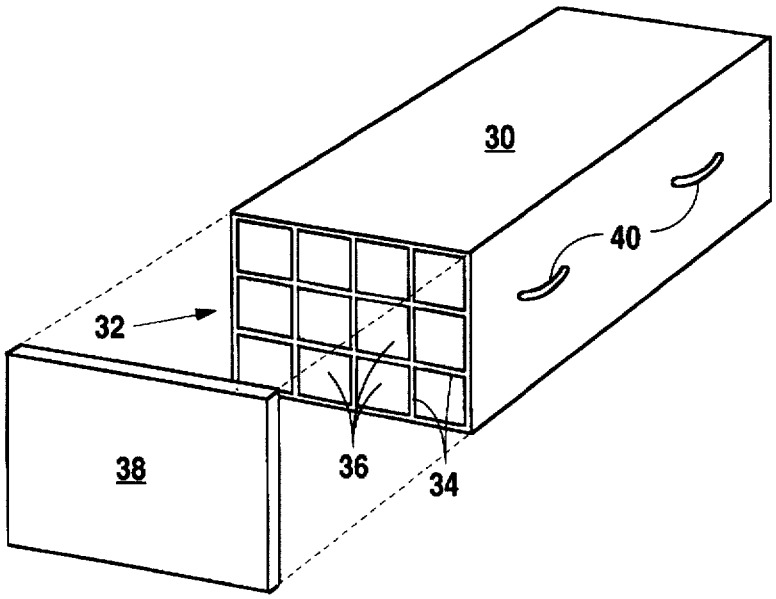
FIG. 2 is an above perspective view of a second embodiment of a device according to the invention.

FIG. 2 illustrates a second embodiment of the invention which generally comprises a cabinet 30 having an interior space 32 divided by internal partition members 34 into a number of juxtaposed longitudinally extending cavities 36. A rope (not shown) can be stowed in the cabinet 30 in a manner similar to that as aforesaid. The interior space 32 of the cabinet 30 can be closed by a lid 38 to secure a stowed rope within the cabinet. In use, after the lid 38 has been removed, a rope is withdrawn from the cabinet 30 by firstly withdrawing an eye and placing it over a bollard or attaching it to a chafe chain and then withdrawing a remaining eye from its respective longitudinal cavity. Further withdrawal of this eye causes successive looped portions of the rope stowed in the next adjacent longitudinally extending cavities 30 to also be withdrawn until the whole length of the rope is free of the cabinet 30.

The cabinet has lifting handles 40.

It will be appreciated that a rope withdrawn from the device 10 (cabinet 30) for use can be restowed in the device the method of the invention.

The device may be any suitable size but typical dimensions of one embodiment would be:- length 4 metres; width 0.75 metres; and height 0.5 metres, the device comprising 12 tubular members (or divided into twelve longitudinally cavities) to stow a rope having a diameter of 64 milli-metres and 100 metres in length. For another embodiment typical dimensions would be: length 4 metres; width 1 metre; height 0.7 metres, to stow a rope having a diameter of 88 milli-metres and 100 metres in length.

What is claimed is:

1. A method of stowing a rope comprising the steps of:

placing a first looped portion of the rope in a longitudinally extending cavity;

successively placing looped portions of the rope in additional longitudinally extending cavities, wherein the rope is not bound within any of the cavities and is substantially freely movable therein, and wherein successive portions of the rope are stowed in the additional cavities in such a manner that free ends of the rope extend outwardly from their respective cavities for easy access; and forming at least one of said free ends to provide a spliced eye.

2. A device for stowing a rope comprising:

a plurality of members disposed in a juxtaposed relationship, each member defining a longitudinally extending cavity for receiving a looped portion of the rope therein;

each member being tubular and including at least one open end through which a looped portion of the rope can be inserted for stowage in the cavity and withdrawn for use;

a base member on which the tubular members are disposed and secured; and the base member including handle means for enabling said device to be lifted.

3. A device as claimed in claim 2, wherein the tubular members are arranged such that the longitudinal axes of their respective cavities are generally parallel.

4. A device as claimed in claim 2, wherein the tubular members have substantially identical cross sections.

5. A device as claimed in claim 2, further comprising an adhesive for securing together the tubular members in the juxtaposed relationship.

6. A device as claimed in claim 2, wherein the tubular members have a generally rigid construction.

7. A device as claimed in claim 2, wherein the tubular members comprise heavy duty fabric tubes.

8. A device as claimed in claim 2, wherein the device includes at least one strap means for securing the tubular members to the base member, the strap extending from one edge portion of the base member around the tubular members to an oppositely facing edge portion of said base member.

9. A device as claimed in claim 2, wherein the tubular members are secured to the base member by means of an adhesive.

10. A device as claimed in claim 2, wherein the base member comprises a housing accommodating the tubular members therewithin.

11. A device as claimed in claim 2 wherein the base member includes means for enabling said device to be towed.

12. A device for stowing a rope comprising:

a plurality of members disposed in a juxtaposed relationship, each member defining a longitudinally extending cavity for receiving a looped portion of the rope therein;

each member being tubular and including at least one open end through which a looped portion of the rope can be inserted for stowage in the cavity and withdrawn for use;

a base member on which the tubular members are dispersed and secured; and the base member including means for enabling said device to be towed.

* * * * *